United States Patent [19]

Smith, Jr. et al.

[11] 3,997,936

[45] Dec. 21, 1976

[54] VACUUM CLEANING APPARATUS

[75] Inventors: Sumner Smith, Jr., Cohasset; Wladyslaw Typrowicz, Westford; Horst M. Leonhardt, Brockton, all of Mass.

[73] Assignee: Abington Incorporated, North Abington, Mass.

[22] Filed: Nov. 24, 1975

[21] Appl. No.: 634,925

[52] U.S. Cl. ..... 15/301; 19/107; 57/56

[51] Int. Cl.[2] ..... D01G 15/76

[58] Field of Search ..... 15/301, 312 R; 19/107; 57/56

[56] References Cited

UNITED STATES PATENTS

| | | | |
|---|---|---|---|
| 1,108,070 | 8/1914 | France | 19/107 |
| 1,642,235 | 9/1927 | Fliedner | 19/107 |
| 3,943,596 | 3/1976 | Wright et al. | 15/301 |

FOREIGN PATENTS OR APPLICATIONS

| | | | |
|---|---|---|---|
| 672,426 | 10/1964 | Italy | 19/107 |
| 1,009,502 | 11/1965 | United Kingdom | 19/107 |
| 1,082,628 | 9/1967 | United Kingdom | 19/107 |

*Primary Examiner*—Christopher K. Moore
*Attorney, Agent, or Firm*—Robert T. Gammons

[57] ABSTRACT

Apparatus for removing waste, lint, dust, dirt and other accumulations of solid matter from the underside of machinery, especially textile machinery such as carding machines while the latter is in operation or not, comprising a frame designed to be installed beneath the machine on the floor on which there is reciprocally mounted a wiper arranged to travel over the floor in reciprocation so as to traverse the entire area beneath the machine, vacuum chambers at two of the opposite ends of the frame having open sides parallel to the wiper which are closed by the wiper when the latter reaches an end position and a timer operable to connect the chambers to a vacuum source as the wipers are moved to a position closing them to remove the waste swept into the chambers by the wiper. The opposite ends of the vacuum chambers are open and the vacuum connections to the chambers are situated at the mid-length thereof so that strong drafts are created as the air rushes into the open ends along the floor to the vacuum connections at mid-length which augment the lifting effect on the fibers.

14 Claims, 7 Drawing Figures

VACUUM CLEANING APPARATUS

BACKGROUND OF INVENTION

Due to the fact that the extraneous materials such as fines, lint and the like produced during the processing of fibers to yarn as, for example, carding operations an in the processing of yarn as, for example, weaving operations constitute a fire hazard and that if such extraneous material is not removed it may become entrained in the yarn or cloth, which is highly undesirable, various means have been designed to periodically removing extraneous matter from the processing apparatus. This is sometimes done by blowing the material away from the operating instrumentalities and from the yarn or cloth being formed an in other cases by vacuuming, the latter being the more desirable because the material can be collected and disposed of. In the U.S. Pat. No. to Maguire 3,142,856 a vacuum system is illustrated in conjunction with a weaving machine comprising a screen located in a plane below the work as it is woven for receiving the lint or fines which drop down, a sweeper which moves along the surface of the screen to sweep the lint into a vacuum chamber and conduits for drawing off and disposing of the vacuumed material. The disposal system shown in this patent is designed specifically for looms to remove lint directly from the underside of the woven material and so does not have general application to machines where there is a need for removing lint, fines, fragments, dirt and the like from the floor beneath the machine without having to stop the machine. It is for the purpose of this invention to provide improved vacuum cleaning apparatus which may be adapted to remove accumulations of dirt, lint and so forth from the floor at the underside of any machine where such accumulations occur and as herein illustrated is designed to be installed beneath a carding machine for periodically sweeping the floor and disposing of the swept up waste material. Another object of this invention is to provide wherein the vacuum effect is vastly augmented by the design of the vacuum chambers, an apparatus which is designed to be easily installed, an apparatus which is adaptable to machinery of various kinds and for various purposes and an apparatus which is relatively inexpensive to manufacture.

SUMMARY OF INVENTION

As herein illustrated the apparatus comprises a structure designed to be installed on the floor beneath a carding machine, a wiper supported in the structure for reciprocal movement along the floor and in engagement therewith for sweeping the entire area of the floor beneath the machine in the direction of reciprocal movement, means connected to the wiper for effecting reciprocal movement thereof, a vacuum chamber at each end of the structure transversely of the direction of reciprocal movement of the wiper, having an open side facing the wiper and adapted to be closed by the wiper as it is moved to an end position and means for connecting the vacuum chamber to a vacuum source simultaneously with the movement of the wiper to a position closing the open side of the vacuum chamber. In accordance with an important aspect of the invention the opposite ends of the vacuum chambers are open and the vacuum connections to the chambers are situated at the mid-length of the chambers so that a strong draft is created at the open ends as the air rushes into the ends parallel to the floor from the ends to the vacuum connections at mid-length which lift the fibers from the floor. The wiper is a blade corresponding substantially in length to the transverse direction of the floor beneath the machine at right angles to the direction of reciprocal movement and is pivotally supported at one edge to the means for effecting its reciprocal movement so that the distal edge, that is, the lower edge which engages the floor, trails the pivoted edge in the direction of movement of the blade along the floor. The means for supporting the wiper for reciprocal movement comprises a flexible cable entrained about pulleys pivotally mounted on the frame midway between the sides, parallel to the direction of movement to which the blade is pivotally connected midway between its ends and pulleys pivotally mounted on the frame at one side between which there is a double acting air cylinder to the piston of which the ends of the cable extending about the pulleys at the one side are connected. The double acting cylinder is connected to a source of air pressure by means of valves and there is a timer operable to open and close the valves at periodic intervals to supply the air pressure to first one end and then the other of the double acting cylinder thereby to effect reciprocation of the wiper blade. The wiper blade is transversely flexible and has at its lower edge a drag for gathering the waste. There are deflectors mounted at the opposite ends of the frame transversely thereof above the vacuum chambers sloping downwardly and inwardly from the ends for conducting waste dropping from above to the floor between the vacuum chambers and a cover supported lengthwise of the cable. Jets are provided at the ends of the frame supplied with air from the exhaust side of the double acting cylinder to blow fines accumulating on the cover therefrom onto the floor between the vacuum chambers. The frame itself is designed to be disassembled to enable ease of installation The invention will now be described in greater detail with reference to the accompanying drawings:

Carding machines and similar fiber working machines are customarily set into relatively large heavy cast iron frames and although there is considerable space within these frames below the carding cylinder for example, access to this space is limited by the construction of the frame so that it is difficult to remove accumulations of lint or fiber dropped from the carding cylinders during operation. To stop the machinery for this purpose is undesirable and so the apparatus of this invention has been designed to be installed within the plenum space beneath the carding roll of a carding machine to enable removing the fly waste while the machine continues to run and for disposing of the waste. It is to be understood that while this apparatus is designed especially for carding machines it may be employed for other kinds of machinery both textile and otherwise where during the process being carried out on the machine particles of materials are broken off and fall to the floor beneath the machine. Whereas, in mills there are rows of machine wherein the open spaces between adjacent machines is short the apparatus as herein described because of its improved vacuum effect vacuum cleans the areas between machines as well as beneath the machines.

Figure 1:
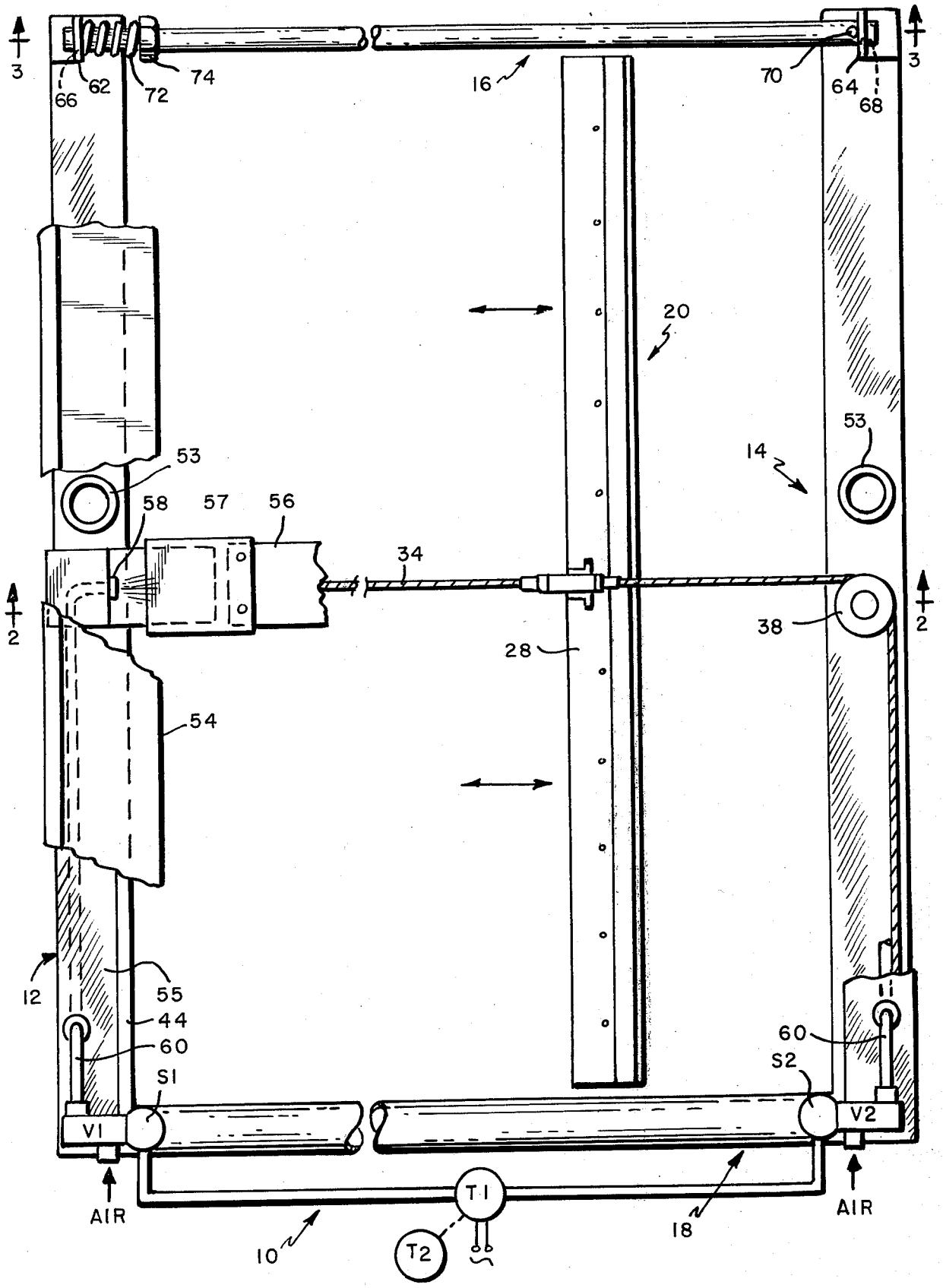
FIG. 1 is a plan view of the apparatus with portions broken away.
Figure 4:
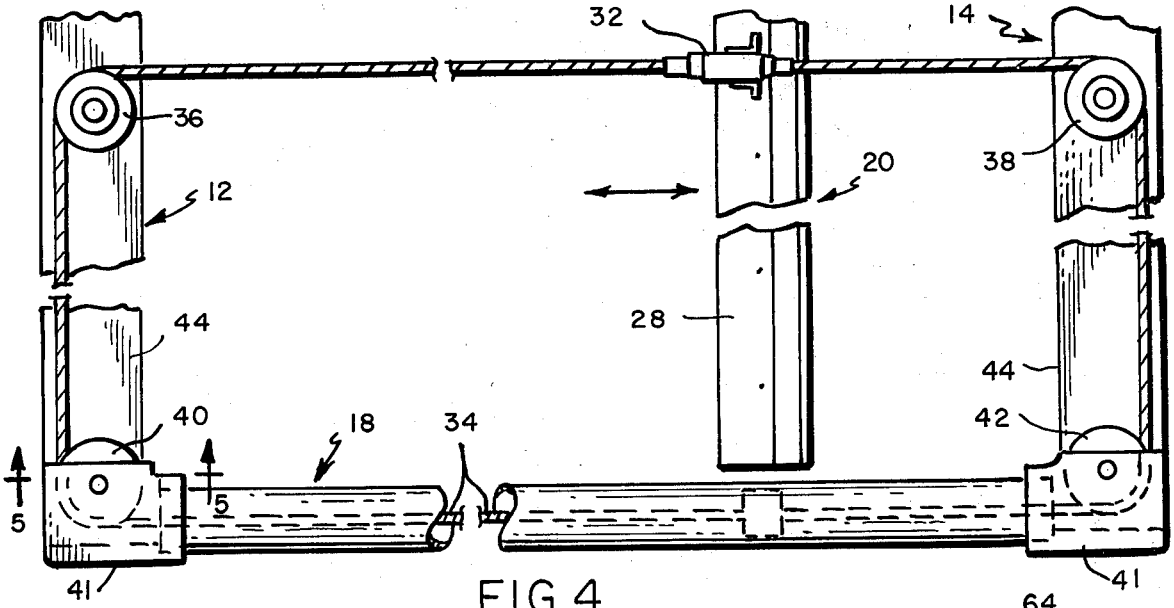
FIG. 4 is a fragmentary horizontal section taken on the line 4—4 of FIG. 2.
Figure 3:
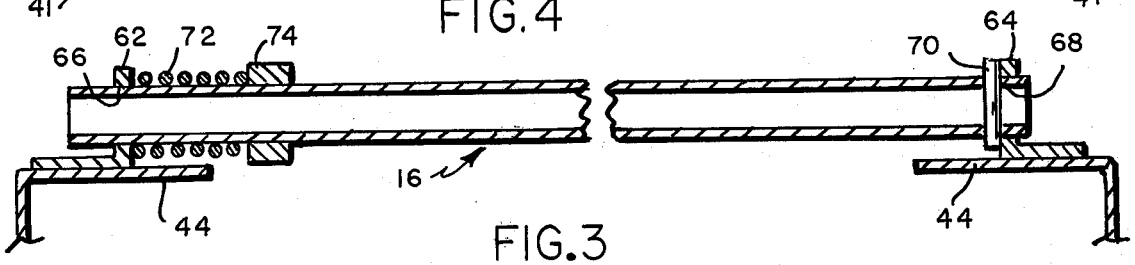
FIG. 3 is a vertical section taken on the line 3—3 of FIG. 1.

The plenum space beneath a carding machine is substantially rectangular and covers a floor area beneath it corresponding substantially to the inside dimensions of the supporting frame. The apparatus of this invention is designed to be installed within this space at the inner sides, that is, between the ends and sides on the floor. Referring specifically to the drawings, FIG. 1, the apparatus comprises a substantially rectangular frame 10 having spaced parallel transversely extending end members 12 and 14 and longitudinally spaced side members 16 and 18 on which there is mounted a wiper 20 for reciprocal movement along and in engagement with the floor or with a floor covering thereon between the side members 16 and 18 toward and from the end members 12 and 14. The wiper 20 is in the form of an elongate blade corresponding substantially in length to the distance between the side members 16 and 18 which is pivotally supported at its upper edge 22 with its distal edge 24 in contact with the floor so that as it is moved in reciprocation the distal edge of the blades will trail the pivoted edge in the direction of movement. The blade comprises a rigid back 26 to which there is attached a flexible lip 28 at the lower edge of which is a drag 30.

The wiper is pivotally supported by a clamp block 32 clamped to a flexible cable 34 supported in a horizontal plane midway between the opposite sides 16 and 18 and parallel to the floor by pulleys 26 and 38 rotatably mounted on the end frame members 12 and 14 and midway between their ends and by pulleys 40 and 42 pivotally mounted on the ends of the end members at the side 18 about which the ends of the cable are entrained and connected at their ends to means for effecting reciprocal movement of the cable and hence of the wiper.

The means for effecting reciprocal movement of the cable is a double acting cylinder which, as herein illustrated, constitutes the side member 18 of the frame which is pivotally connected at its ends to the ends of the end members at this side by coupling members 41—41 at its ends which are pivoted to the end members on studs 43—43 screwed into the ends of the end members. These same studs rotatably support the pulleys 40, 42.

Valves V1 and V2 are provided at the ends of the cylinder and there is a timer T1 which alternately through solenoids S1, S2 supply air from a source of pressure to the cylinder to move the piston first in one direction and then the other. The timer may be set to operate the wiper periodically, continuously or at intervals depending upon the rate of accumulation of the waste beneath the machine.

Figure 2:
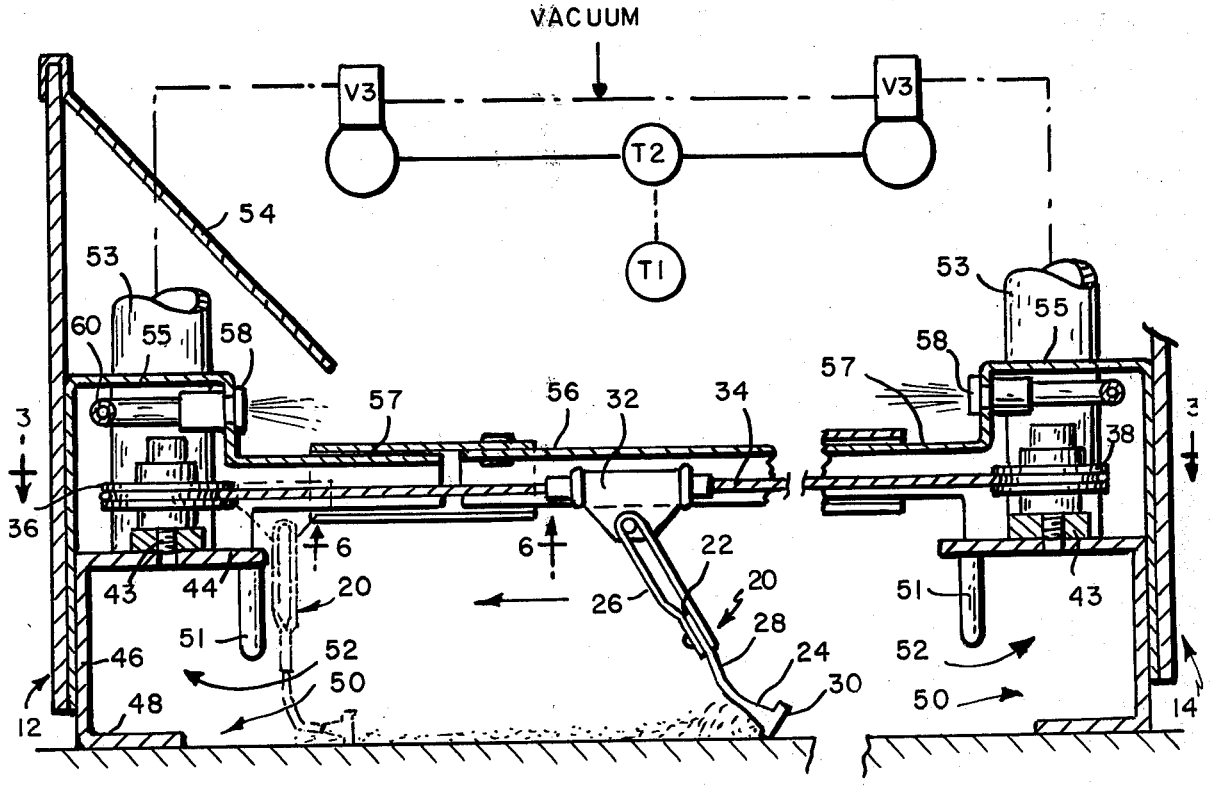
FIG. 2 is a vertical section taken on the line 2—2 of FIG. 1.
Figure 5:
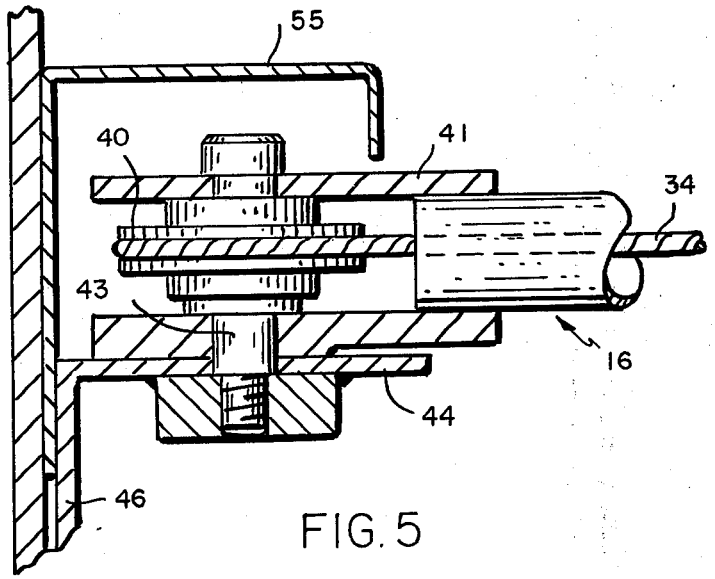
FIG. 5 is a fragmentary vertical section taken on the line 5—5 of FIG. 4.
Figure 6:
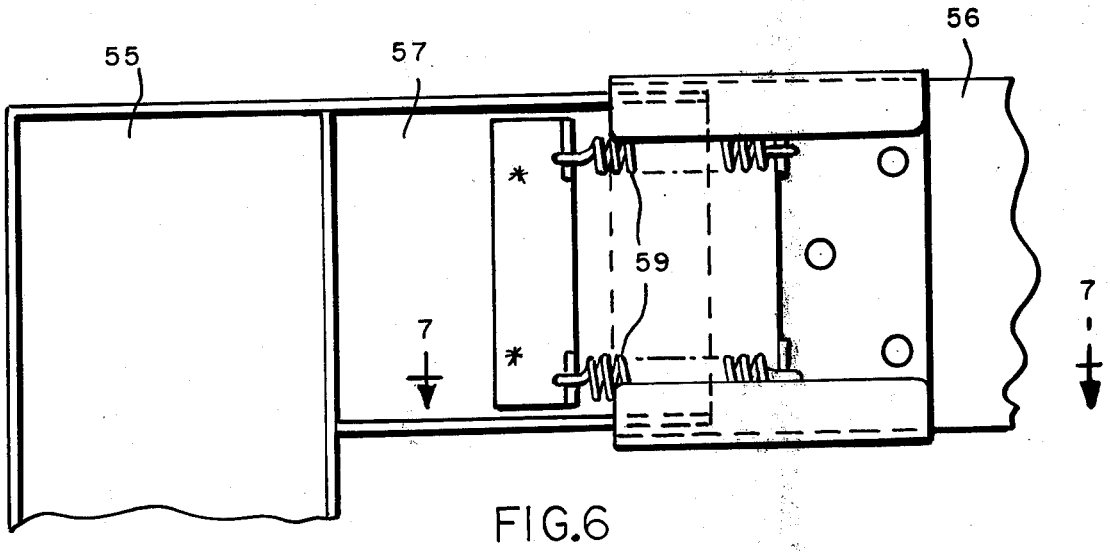
FIG. 6 is a fragmentary plan view taken on the line 6—6 of FIG. 2.
Figure 7:
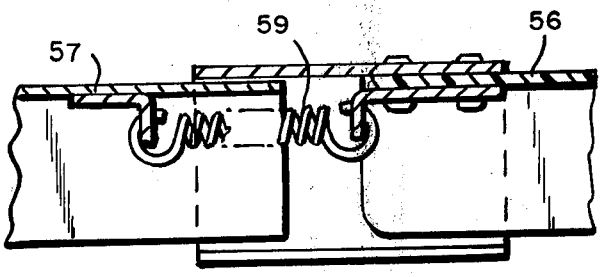
FIG. 7 is a section taken on the line 7—7 of FIG. 6.

Each of the end members 12 and 14 constitutes a vacuum chamber which, as illustrated in FIG. 2, is a hollow structure having a top wall 44, a side wall 46, a bottom wall 48 and an open side 50 which faces the inside, that is, the wiper and open ends. The chamber 52 defined by the walls 44, 46 and 48 extends all the way across the structure and is connected through the top wall 44 midway between its ends to a flexible conductor 53 which in turn is connected to a source of vacuum by way of a valve V3 which is open and closed by a second timer T2 which holds the valve V3 open for a predetermined time and then closes it. Operation of the second timer is initiated by the first timer within the time required for the wiper to move to the closing position.

In operation, as the wiper moves to one end or the other of the frame, it closes the open side of the chamber 52 at the end position sweeping the fibers before it into the chamber. Simultaneously with closing of the vacuum chamber the valve to the vacuum source is opened so as to connect the vacuum to the vacuum chamber and to thus withdraw the fibers from the vacuum chamber. Pins 51 fixed to the underside of the top wall 44 prevent the wiper from swinging into the vacuum chamber. An important aspect of the construction of the vacuum chamber resides in the use of a vacuum chamber having open ends and a vacuum connection at mid-length such that strong currents of air rush in from the ends substantially parallel to the floor towards the vacuum connections which lift the fibers. As herein illustrated, the ends of the chambers are approximately half an inch from the inner side of the machine frame. This improved vacuum design is in marked contrast to conventional vacuum equipment wherein the flow takes place along the entire length of the longitudinal edges of the chamber and is thus so diminished in force that it is largely ineffective. To produce the necessary flow with conventional equipment would require the use of such high vacuum as to make the equipment uneconomical.

The apparatus as thus designed has a further advantage in that because the vacuum chambers are open at their ends and a strong current of air is induced into these open ends substantially parallel to the floor, the fibers on the floor surrounding the machine or between adjacent machines is effectively drawn in through the open ends of the chambers and carried away with the fibers which have already been swept into the chambers by the wipers. Thus, the apparatus has a double effect of not only cleaning the floor beneath the machine but also cleaning the floor around and intermediate adjacent machines.

In order to direct those fibers falling from above at the ends of the machine into the space between the vacuum chambers so that they will not accumulate on top of the vacuum chambers there are provided deflectors 54—54 at each end comprising flat plates fastened to the frame which extends downwardly and inwardly at a sufficiently deep pitch to cause the fibers to slide off onto the floor between the chambers. Covers 55—55 are mounted on the end members so as to overlie the pulleys and at mid-length each cover has an extension 57 which overlies the cable. To prevent an accumulation of fibers on the cable a flexible cable cover 56 which extends lengthwise thereof is mounted between the extension 57—57 and to prevent accumulation of fibers on the cable cover there are provided jets 58—58, one at each end, for blowing the fibers off the cover. The jets are mounted on the covers 55 and are connected by conductors 60—60 to the valves V1 and V2. The valves are so arranged that as the piston in the double acting cylinder moves in a direction to exhaust air from the end of the cylinder toward which the piston is moving the exhaust air will be supplied to the jet 58 at that end to project a blast of air along the upper surface of the cover 56. The cable cover is yieldably connected at its ends to the extensions 57—57 by springs 59—59.

It is, as a practical matter, undesirable to remove large textile machinery such as carding machines from the floor to permit installing a frame of the aforesaid kind beneath it and is also impractical to try to build or construct such a frame within the limited space permitted by the construction of the base and so this frame is designed to be disassembled to an extent to enable building it to specifications outside of the machine under which it is to be installed and then installing it with a minimum amount of labor. To this end, as previously indicated, the ends of the end members 12 and 14 are pivotally connected to the double acting cylinder by threaded studs 43 which may be removed to disconnect the cylinder from the end members. The other ends of the end members are connected to the side member 16 which is in the form of a rigid rod by means of bracket members 62 and 64 fixed to the ends of the end members 12, 14 containing openings 66 and 68 which receive the ends of the rod 16. A pin 70 is fixed to the rod at the inner side of the bracket 64 and a coil spring 72 is mounted on the rod at the inner side of the bracket 62 between it and a nut 74 threaded onto the rod. As thus constructed the rod 16 may be disengaged from the ends of the end members at that side by moving it longitudinally against the compression of the spring 72 until the opposite end of the rod can be disengaged from the opening in the bracket 68. The spring 72 serves also to hold the end members extended in spaced parallel relation when once installed and imparts tautness to the cable.

The apparatus as thus described is quite simple in construction and operation, highly effective and requires substantially no extraordinary procedure for installation and/or maintenance.

It should be understood that the present disclosure is for the purpose of illustration only and includes all modifications or improvements which fall within the scope of the appended claims.

I claim:

1. Apparatus for continuously removing waste from beneath a machine, comprising a structure designed to be installed on the floor beneath the machine, a wiper supported on the structure for reciprocal movement along the floor and in engagement therewith for sweeping the entire area of the floor beneath the machine transversely in the direction of reciprocal movement, means connected to the wiper for effecting reciprocal movement thereof, a vacuum chamber at each end of the structure situated transversely of the direction of reciprocal movement of the wiper having an open side facing the wiper and open ends each of said open sides being adapted to be closed by the wiper as it moves to an end position adjacent the corresponding open side, a vacuum port midway between the open ends of each of the chamber and means for sequentially connecting each of the vacuum port to a source of vacuum simultaneously with the movement of the wiper to a position closing the open side of the corresponding one of the vacuum chamber.

2. Apparatus according to claim 1, wherein the wiper is a blade corresponding substantially in length to the transverse dimension of the floor on which it rests at right angles to the direction of reciprocal movement, and is pivotally supported at one edge to the means for effecting its reciprocal movement so that the distal edge trails the pivoted edge in the direction of movement of the blade along the floor.

3. Apparatus according to claim 1, wherein the means supporting the wiper for reciprocal movement along the floor comprises a flexible cable entrained about pulleys mounted on the frame midway between the sides parallel to the direction of movement to which the blade is pivotally connected midway between its ends.

4. Apparatus according to claim 1, wherein the means for supporting the wiper for reciprocal movement along the floor comprises a flexible cable entrained about pulleys mounted on the frame midway between the sides and parallel to the direction of movement and pulleys mounted at one side parallel to the direction of reciprocal movement and a double acting air cylinder at said one side to the piston of which the ends of the cable are connected.

5. Apparatus according to claim 4, comprising means for periodically reversing the air pressure supplied to the air cylinder to effect reciprocation of the blade.

6. Apparatus according to claim 4, comprising valves for connecting opposite ends of the air cylinder to a source of pressure and a timer for periodically reversing the valves to effect reciprocation of the blade.

7. Apparatus according to claim 4, comprising a cover on the frame extending along the cable, an air jet on the frame at each end arranged to deliver a jet of air along the cover and means connecting the ends of the double acting cylinder to the jets so that air exhausted from the cylinder is supplied to the jets.

8. Apparatus according to claim 1, wherein the wiper is a blade which is transversely flexible and has at its distal edge a drag.

9. Apparatus according to claim 7, wherein there are means yieldably connecting the cable cover to the end members.

10. Apparatus according to claim 1, comprising deflectors mounted at the ends of the frame transversely of the direction of movement above the vacuum chamber, said deflectors sloping downwardly and inwardly from the ends for conducting waste at the ends to the floor between the vacuum chambers.

11. Apparatus for continuously removing waste from beneath a machine, comprising a frame having spaced parallel end members and spaced parallel side members, a wiper supported on the frame parallel to the end members for reciprocation between the side members from one end to the other, said end members embodying vacuum chambers open at the sides facing each other and open at their opposite ends, means for effecting reciprocation of the blade, a vacuum port midway between the open ends of each chamber and means for individually evacuating each of the vacuum chambers through its respective port simultaneously with movement of the wiper to a closing position with respect to the respective end chambers, said end members being detachably connected at their ends to the ends of the side members to enable dismounting the side and end members to facilitate installation of the apparatus beneath the machine.

12. Apparatus according to claim 11, wherein the detachable side member at one side is a rigid rod, and there are means at the ends of the end members for receiving the ends of the rod.

13. Apparatus according to claim 11, wherein the detachable side member is a rigid rod and there are bracket members at the ends of the end members containing openings for receiving the ends of the rod, means fixing one end of the rod relative to the bracket within which it is received and means yieldably connecting the other end of the rod to the other end member.

14. Apparatus according to claim 11, wherein the side member at one side is a double acting cylinder pivotally connected at its ends to the ends of the end members at that side.

* * * * *